United States Patent [19]

Murata

[11] 4,420,264

[45] Dec. 13, 1983

[54] STRUCTURE FOR PREVENTING THE ROTATING OF A REGISTER RING OF A DIVER'S WATCH

[75] Inventor: Toshio Murata, Tanashi, Japan

[73] Assignee: Citizen Watch Co., Ltd., Tokyo, Japan

[21] Appl. No.: 416,562

[22] Filed: Sep. 10, 1982

[30] Foreign Application Priority Data

Sep. 18, 1981 [JP] Japan ..... 56-138533[U]
Jul. 9, 1982 [JP] Japan ..... 57-119588

[51] Int. Cl.[3] ..... G04B 19/20; G04B 39/00; G05G 5/06; G09F 9/00

[52] U.S. Cl. ..... 368/223; 368/276; 368/294; 116/279; 116/315

[58] Field of Search ..... 368/223, 224, 228, 232, 368/233, 276, 294, 295, 296; 74/10 R; 116/279, 280, 284, 315

[56] References Cited

U.S. PATENT DOCUMENTS

| | | | |
|---|---|---|---|
| 3,111,003 | 11/1963 | Droz | 368/233 X |
| 3,124,928 | 3/1964 | Brunet | 368/295 |
| 3,427,800 | 2/1969 | Blum | 368/223 |
| 3,475,902 | 11/1969 | Wessel | 368/228 X |
| 3,505,808 | 4/1970 | Eschle | 368/228 X |
| 3,512,353 | 5/1970 | Blum | 368/295 |
| 3,548,588 | 12/1970 | Piquerez | 368/294 |
| 3,553,958 | 1/1971 | Grohoski | 368/294 |
| 3,757,513 | 9/1973 | Tokunga | 368/294 X |
| 3,979,902 | 9/1976 | Miyasaka et al. | 368/294 |
| 4,067,186 | 1/1978 | Grohoski et al. | 368/294 |
| 4,218,873 | 8/1980 | Lang | 368/276 X |
| 4,244,044 | 1/1981 | Olsson | 368/224 X |
| 4,320,480 | 3/1982 | Schonhardt | 368/233 X |

*Primary Examiner*—J. V. Truhe
*Assistant Examiner*—Terrance L. Flower
*Attorney, Agent, or Firm*—Birch, Stewart, Kolasch & Birch

[57] ABSTRACT

A diver's watch having a watch case and a register ring which is rotatably mounted on the watch case to set a diving time. The register ring has a plurality of notches on the underside thereof and is urged by clicks made of spring plate and held by a holding ring secured to the watch case. A plurality of lock notches are formed on the outer periphery of the watch case. A lock pin is projected from the inside of the register ring and engaged with one of the lock notches, so that the register ring is locked to the watch case. When the register ring is depressed against the clicks, the lock pin disengages from the lock notch, so that the register ring can be rotated.

7 Claims, 10 Drawing Figures

STRUCTURE FOR PREVENTING THE ROTATING OF A REGISTER RING OF A DIVER'S WATCH

BACKGROUND OF THE INVENTION

The present invention relates to a structure for preventing the rotating of a register ring of a diver's watch.

A diver's watch is provided with a rotatable register ring having sixty minutes of indications. The register ring is rotated and set to a position indicating a diving time within which the diver must return to the surface of the water. If the register ring is forcibly rotated to a longer time position by accidental contact with an object in the water, such as rocks, the diver might continue to dive beyond his limit of diving time depending upon the amount of air present in the air cylinder, which may be dangerous to the diver. Therefore, the register ring must be prevented from rotating from a set position in order to avoid such a danger.

SUMMARY OF THE INVENTION

An object of the present invention is to provide a structure which reliably prevents the inadvertent rotation of a register ring on a diver's watch.

Another object of the present invention is to provide a click structure for a register ring which precisely secures the register ring to a set position.

According to the present invention, there is provided an improved structure for preventing the rotating of a register ring on a diver's watch of the type having a watch case with an upright portion, wherein a plurality of notches are formed on the underside of said register ring, each of said notches being in form of a groove which is radially arranged. At least three elastic click members are secured to said watch case, with the end of each click member engaging with one of said notches and urging said register ring upwardly. A holding ring is secured to said watch case for holding the register ring. A plurality of lock notches are formed on said upright portion of the watch case, each of said lock notches being in the form of a groove which is axially arranged. A lock pin projects from said register ring and engages one of said lock notches, said lock notches and notches of said register ring corresponding with each other in angular position of the register ring. The lock pin and lock notches are arranged so that when said register ring is depressed against the elasticity of the click members, the lock pin disengages from the corresponding lock notch.

BRIEF DESCRIPTION OF THE DRAWINGS

These and other objects and features of the present invention will become more apparent from the following description with reference to the accompanying drawings, wherein.

DESCRIPTION OF THE PREFERRED EMBODIMENTS

Figure 1:
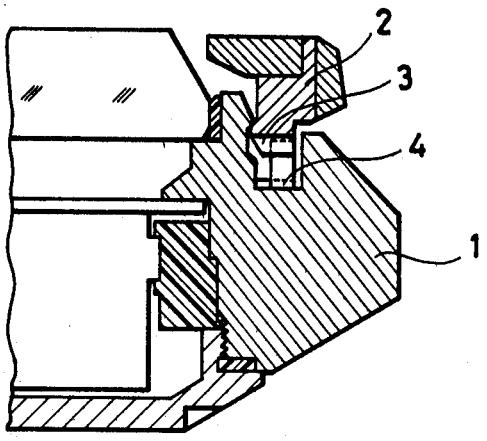
FIG. 1 is a sectional view showing a conventional diver's watch.

Referring to FIG. 1, a conventional diver's watch comprises a watch case 1, a register ring 2 rotatably engaged with the outer periphery of the watch case 1 and having a plurality of engaging notches 3 formed on the underside thereof and click springs 4 engaged with the engaging notches 3. The register ring 2 can be rotated against the click springs 4 and positioned at a location by the click springs thereby setting a diving time.

However, in such a structure, the register ring can be readily rotated by contacting the ring with an object during the diving operation.

The present invention provides a structure for preventing the accidental rotation of the register ring.

Figure 8:
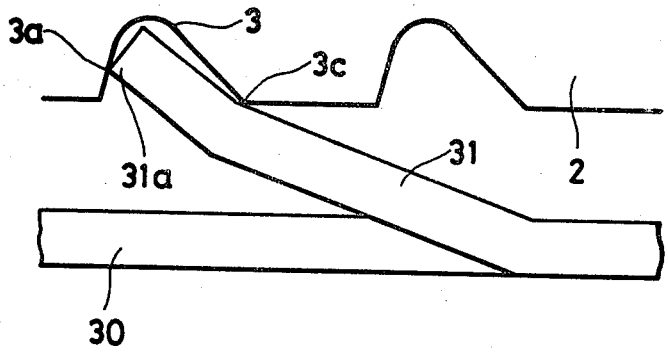
FIGS. 8, 9 and 10 are respective side views showing three kinds of click portions formed in the click plate.

Referring to FIGS. 2 to 6, a diver's watch according to the present invention comprises a case 1, a glass 5 engaged with the upper inside portion of the case 1 with interposed packings 6 and 7 made of Teflon, and a register ring 2. The glass 5 is secured to the case 1 by a ring screw 8 engaged with a thread 9 formed on the upper inside of an upright portion 1*a* of the case 1 with a ring 10 made of Teflon interposed therebetween. A back 11 is secured to the case 1 by thread engagement, with a packing 12 interposed therebetween. The register ring 2 comprises a ring member 14 and an annular dial 13 secured to the ring member 14 through a packing 28. A plurality of notches 3 are formed on the underside of the ring member 14 in the form of a groove, as shown in FIG. 8. Each notch 3 has a saw-toothed shape and the groove is radially oriented.

Figure 4:
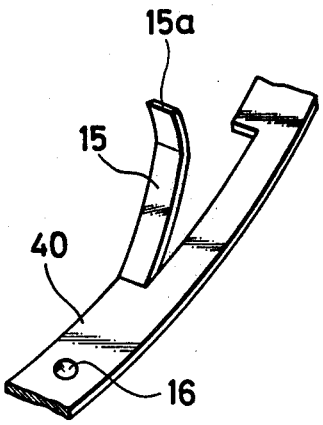
FIG. 4 is a perspective view of a part of an annular click plate.
Figure 7:
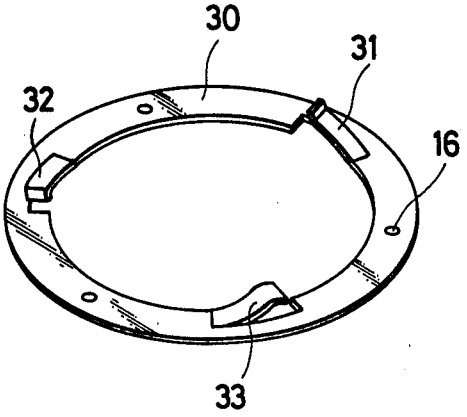
FIG. 7 is a perspective view of a click plate of another embodiment of the present invention.
Figure 5:
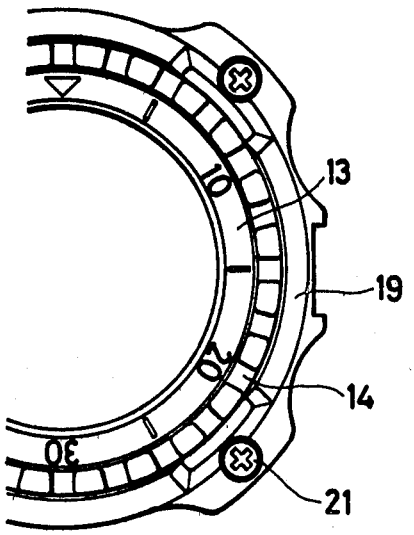
FIG. 5 is a plan view of the diver's watch of FIG. 2.
Figure 6:
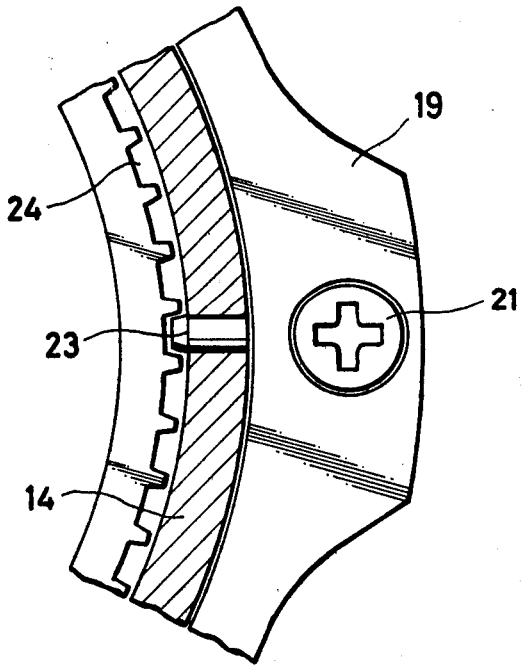
FIG. 6 is a sectional view taken along the line VI—VI of FIG. 2.

As shown in FIG. 4 and FIG. 7, an annular click plate 40 made of a spring plate material is provided with three elastic click portions 15 which are formed by punching out portions of the plate 40 at an angle 120° and disposed equidistant from each other. The spring plate is secured to the case 1 by engagement with a pin 16 projecting from a shoulder 17 of the case. An end portion of each click portion 15 is cambered to engage with the notch 3. The register ring 2 is urged upwardly by the click portion 15, so that a flange 18 formed on an outer periphery of a lower portion of the register ring 2 is engaged with an overhang 20 formed in the inside of a register ring holding ring 19. The register ring holding ring 19 is secured to the case 1 by screws 21.

Lock notches 24, corresponding to minute indications on the dial 13, are formed in the form of a groove on the periphery of the upright portion 1*a* of the register ring 2. The groove of each lock notch 24 is axially arranged. On the other hand, a lock pin 23 is securely mounted in a horizontal hole 22 formed in the register ring 2. The lock pin 23 projects inwardly so as to engage with one of the lock notches 24. The engagement between the lock pin 23 and lock notch 24 is adapted to correspond to the engagement of the click portions 15 with notches 3 of the register ring 2.

The operation of the register ring will now be described.

Figure 2:
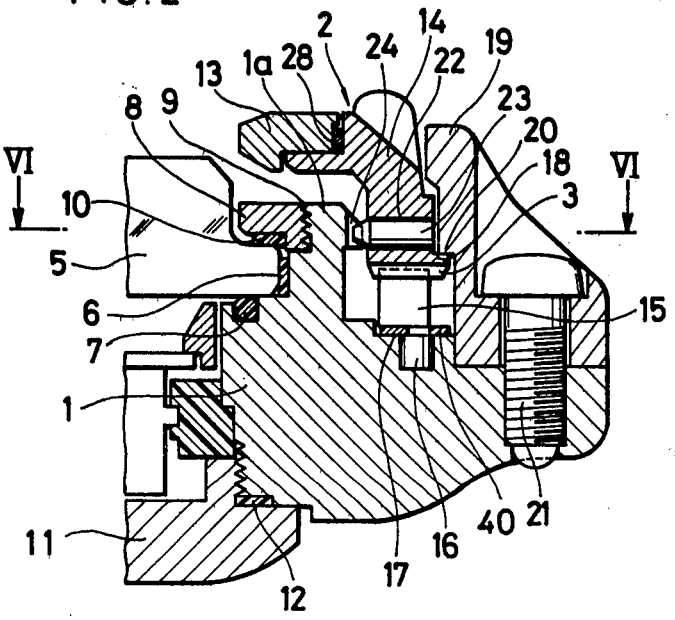
FIG. 2 is a sectional view of a diver's watch according to the present invention, in which a register ring is in a locked state.

Referring to FIG. 2, the register ring 2 is locked by engagement of the lock pin 23 with one of the lock notches 24, so that the register ring 2 is prevented from rotating.

Figure 3:
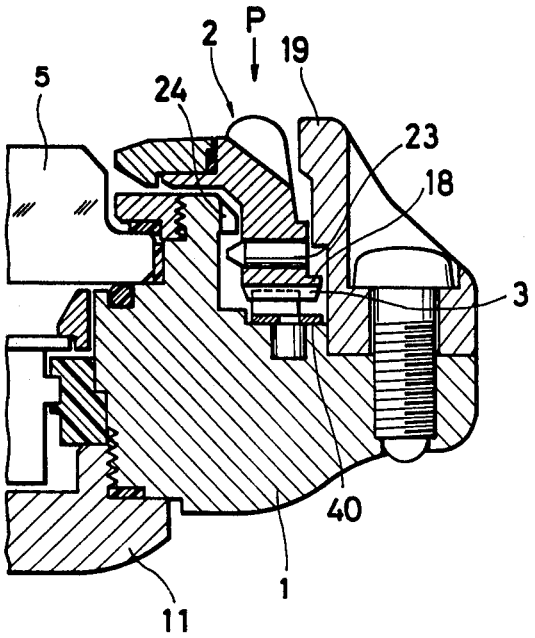
FIG. 3 is a sectional view of the diver's watch of FIG. 2, in which the register ring is in a released state.

As shown in FIG. 3, when the register ring 2 is depressed in the direction of an arrow P against the elasticity of the click portion 15, the lock pin 23 is disengaged from the lock notch 24. Thus, the register ring 2 is released, so that the register ring 2 can be rotated, while depressed, against the elasticity of the click portion 15. Since the tip end 15*a* of the click portion engages with the steep slant portion 3*a* of the notch 3, the register ring 2 can be rotated only towards the steep slant side. By this arrangement, the register ring can be rotated in the direction which decreases the set time for diving. After rotating the register ring 2 to a desired time position, the depression of the register ring 2 is released. The register ring 2 is raised by the elasticity of the click portion 15, so that the lock pin 23 engages with the corresponding notch 24 to lock the register ring 2 in the set position.

In accordance with the present invention, the lock pin locks the register ring in a set position by preventing the register ring from rotating, thereby avoiding a dangerous condition during diving.

FIGS. 7 to 10 show another embodiment of the present invention.

Figure 9:
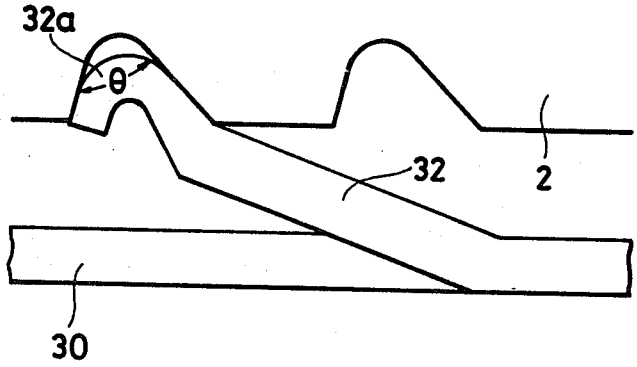
Figure 10:
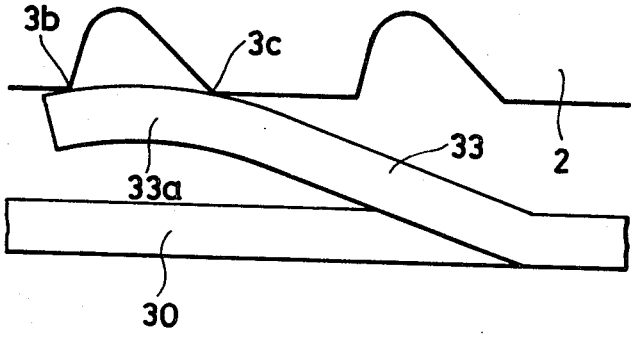

As shown in FIG. 7, a click plate 30 has three different click portions, that is, a first click portion 31, a second click portion 32, and a third click portion 33. As shown in FIG. 8, an end portion of the first click portion 31 is slightly cambered, so that an edge 31*a* may engage with the steep slant portion 3*a* of the notch 3. An end portion of the second click portion 32 is curved to form a V-shaped end portion 32*a* as shown in FIG. 9. An angle $\theta$ between both outsides of the end portion 32*a* is larger than the angle between both sides of the notch 3, so that the outsides of the end portion 32*a* snugly engages with the notch. As shown in FIG. 10, the third click portion 33 has a curved end portion 33*a* which has a curvature larger than that of the second click portion 32. The remaining structure is the same as the first embodiment.

In the set state of the register ring 2, the first click portion 31 and the second click portion 32 engage with corresponding notches 3, respectively, while the curved end portion 33*a* of third click portion 33 engages with opposite edge 3*b* and 3*c* of the notch 3 as shown in FIG. 10. The first click portion 31 acts to elevate the register ring 2 by the engagement with the edge 3*c* and to prevent the rotation of the register ring in the reverse direction by the engagement of the edge 31*a* with the steep slant 3*a*. Since the V-shaped end portion 32*a* of the second click portion 32 snugly engages with the notch 3, the register ring is exactly positioned by the second click portion in the desired position. In other words, the second click portion acts to position the register ring and also to elevate it. The third click portion 33 elevates the register ring. Thus, the register ring is elevated by three click portions in an equilibrium state and set with accuracy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A diver's watch comprising a watch case;

an annular upright portion formed on said watch case and having a plurality of lock notches disposed at the peripheral portion thereof, each of said lock notches being in the form of an axially extending groove;

a register ring rotatably and axially, movably provided at the outside of said upright portion of said watch case and having a plurality of notches at the underside thereof, each of said notches being in the form of a radially extending groove;

at least three elastic click members secured to said watch case, one end of each of said click members engaging with one of said notches and urging said register ring in the upward direction;

a holding ring disposed outside the register ring and secured to said watch case for holding said register ring;

a lock pin inwardly projected from said register ring and engaged with one of said lock notches; and said lock notches and notches of said register ring corresponding with each other in the angular position of the register ring, wherein said lock pin and lock notches are so arranged so that when said register ring is depressed against the elasticity of said click members, said lock pin disengages from the corresponding lock notch.

2. The diver's watch according to claim 1 wherein said click members are formed by punching out a portion of an annular spring plate.

3. The diver's watch according to claim 2 wherein each notch formed on the underside of said register ring has a saw-toothed shape.

4. The structure according to claim 3 wherein one of said click members has an edge engaging with the steep slanting portion of said notch.

5. The structure according to claim 4 wherein one of said click members has a V-shaped end portion which snugly engages with one of said notches.

6. The structure according to claim 5 wherein one of said click members has a curved end portion which engages with the opposite edges of one of said notches.

7. A click structure for a diver's watch having a watch case and a register ring having a plurality of notches at the underside thereof, which comprises;

at least three elastic click members secured to said watch case, one end portion of each of said click members engaging with one of said notches, one of said click members having an edge portion engaging with a slanting portion of one of said notches and, another one of said click members having a V-shaped end portion snugly engaging with another of said notches.

* * * * *